US005807170A

United States Patent [19]

Lee

[11] Patent Number: 5,807,170

[45] Date of Patent: Sep. 15, 1998

[54] METHODS AND APPARATUS FOR OPENING AND CLOSING THE AIR INLET AND OUTLET OF AN AIR CONDITIONER

[75] Inventor: Gab-Youl Lee, Suwon, Rep. of Korea

[73] Assignee: Samsung Electronics Co., Ltd., Suwon, Rep. of Korea

[21] Appl. No.: 769,672

[22] Filed: Dec. 19, 1996

[30] Foreign Application Priority Data

Dec. 30, 1995 [KR] Rep. of Korea ..... 95-69112

[51] Int. Cl.[6] ..... F24F 1/02; F24F 13/20

[52] U.S. Cl. ..... 454/233; 454/324

[58] Field of Search ..... 454/229, 230, 454/231, 233, 234, 324, 334; 49/13; 251/129.12

[56] References Cited

U.S. PATENT DOCUMENTS 4,099,704 7/1978 Okumura et al. ..... 251/129.12

5,443,420 8/1995 Kim et al. ..... 454/256

5,461,875 10/1995 Lee et al. ..... 454/324 X

FOREIGN PATENT DOCUMENTS 63-286650 11/1988 Japan ..... 454/233

*Primary Examiner*—Harold Joyce

*Attorney, Agent, or Firm*—Burns, Doane, Swecker & Mathis, L.L.P.

[57] ABSTRACT

An air conditioner includes an air inlet, an air outlet, a fan for circulating air from the inlet to the outlet, and a heat exchanger for heating or cooling the circulated air. Inlet and outlet doors are provided which can be moved between opened and closed states. In their closed states those doors prevent dust and other foreign substances from entering the air conditioner. Motors are provided for opening and closing the doors, and detectors sense whether the doors have been fully opened or closed. A controller operates the motors on the basis of a user-selected mode of operation, and the detected door positions.

7 Claims, 9 Drawing Sheets

METHODS AND APPARATUS FOR OPENING AND CLOSING THE AIR INLET AND OUTLET OF AN AIR CONDITIONER

BACKGROUND OF THE INVENTION

1. Field of the Invention

The present invention relates to an air conditioner having a discharge outlet to be opened or closed for keeping out dust or foreign substances, and a method therefor.

2. Description of the Prior Art

A conventional air conditioner has, as shown in FIG. 1, an suction grille member 5 having suction inlets 3 for taking in room air which is provided at a front lower portion of a main body 1, an upper discharge outlet 7 for discharging indoors the air heat-exchanged by a heat-exchanger with cold or warm air, and air flow blades 9 and 11 formed in the discharge outlet 7, for adjusting left or right and upward or downward the air discharged indoors through the discharge outlet 7, respectively.

A cover member 13 for protecting the interior of the body 1 is attached to the front surface of the body 1, and is usually designed to give a good appearance thereto.

And, in a lower area of the cover member 13 is disposed a manipulating portion 15 for directing desired operation modes of the air conditioner such as automatic mode, cooling, heating, defrost, air-cleaning, and so forth, and a start/stop of the air conditioner, for adjusting the amount or flow direction of the air discharged through the discharge outlet 7, and for displaying various operational conditions of the air conditioner.

For such a structured conventional air conditioner, if a user selects a desired operational mode through a remote controller at a manual manipulating panel 15 and then depresses a start/stop key (hereinafter referred to as the operation key), an indoor fan, not illustrated, is rotated such that the indoor air introduced into the body 1 through the suction inlet 3 is heat-exchanged by the evaporating latent heat of the refrigerant flowing in the heat-exchanger when the sucked air passes the heat-exchanger.

The air heat-exchanged in the heat-exchanger is guided into an upper portion of the body 1 and then discharged indoors through the discharge outlet 7 with an adjustment of an air flow direction provided by a controlled displacement of air flow blades 9, 11 for accomplishing the conditioning of the room air.

The suction inlet 3 and discharge outlet 7 of such a constructed conventional air conditioner remains opened even during a non-activated state of the air conditioner, which results in the introduction of dust or foreign substances into the main body 1 through the opened suction inlet 3 and discharge outlet 7. Accordingly, dust or foreign substances may be deposited on the surface of the heat-exchanger, which causes a problem in that the performance of the heat-exchanger deteriorates.

Furthermore, when it is intended not to use the air conditioner for a long time, the air conditioner has to be protected against any undesirable foreign substances entering the body. To this end, a vinyl wrapper is usually used as protection for the air conditioner, but which affects an external appearance of the air conditioner.

SUMMARY OF THE INVENTION

Therefore, it is an object of the present invention to provide a discharge outlet opening or closing apparatus for an air conditioner having a suction inlet and a discharge outlet to be opened or closed for preventing dust or other foreign substances from passing through them during an idle state of the air conditioner, and having a performance improved, and method therefor.

The above objects are accomplished by an apparatus for opening/closing a discharging outlet of an air conditioner employing a suction inlet for sucking a room air, an indoor heat exchanger for heat-exchanging the sucked air, and a discharging outlet for discharging the air heat-exchanged by the indoor heat exchanger, the apparatus comprising:

- a discharging outlet door for opening or closing the discharging outlet so as to prevent dust and foreign substances from passing through the discharging outlet;
- a suction inlet door for opening or closing the suction inlet so as to prevent dust and foreign substances from passing through the suction outlet;
- driving means for opening or closing the discharge outlet door and the suction inlet door;
- opening/closing detecting means for detecting the position of the discharge outlet door and the suction inlet door; and
- control means for controlling the driving means such that the discharge outlet door and the suction inlet door are opened or closed based upon the detection signal from the opening/closing detecting means.

Furthermore, according to another aspect of the present invention, it is provided a method for closing or opening a discharge outlet door and a suction inlet door of an air conditioner, the method comprising the steps of:

- determining whether or not the start or stop command signal is input through a key manipulating means;
- controlling driving means and simultaneously opening or closing the discharge outlet door and the suction inlet door in response to the input command signal;
- detecting if the discharge outlet and the suction inlet are opened or closed in correspondence to the opened or closed position of the discharge outlet door and the suction inlet door; and
- controlling an application of a power to the driving means for opening or closing the discharge outlet door and the suction inlet door in response to the detection for the opened or closed position in the detecting step.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
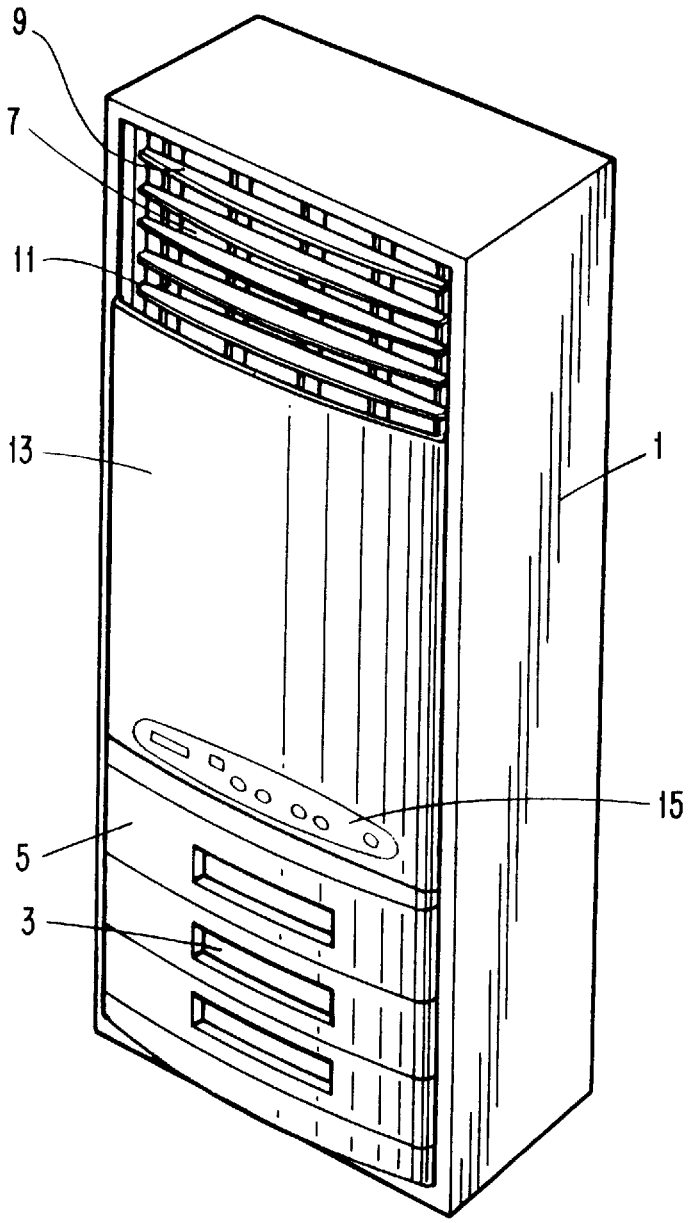
FIG. 1 (PRIOR ART)
FIG. 1 is a schematic front perspective view illustrating a conventional air conditioner.

The preferred embodiment according to the present invention will now be described in detail in accordance with the accompanying drawings.

Throughout the accompanying drawings, like parts are designated by like reference numerals or symbols.

Figure 2:
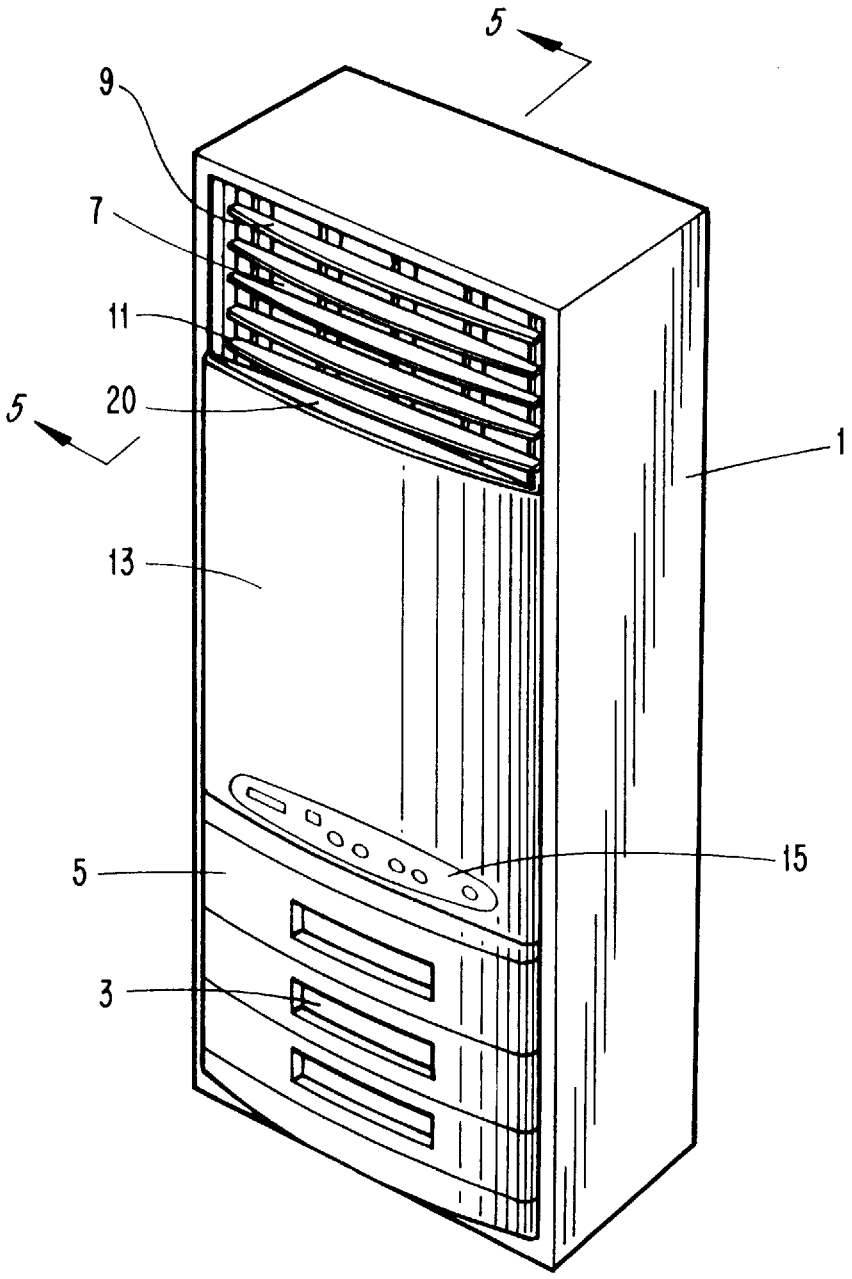
FIG. 2 is a schematic front perspective view illustrating an air conditioner according to the present invention, with a discharge outlet and a suction inlet opened.
Figure 3:
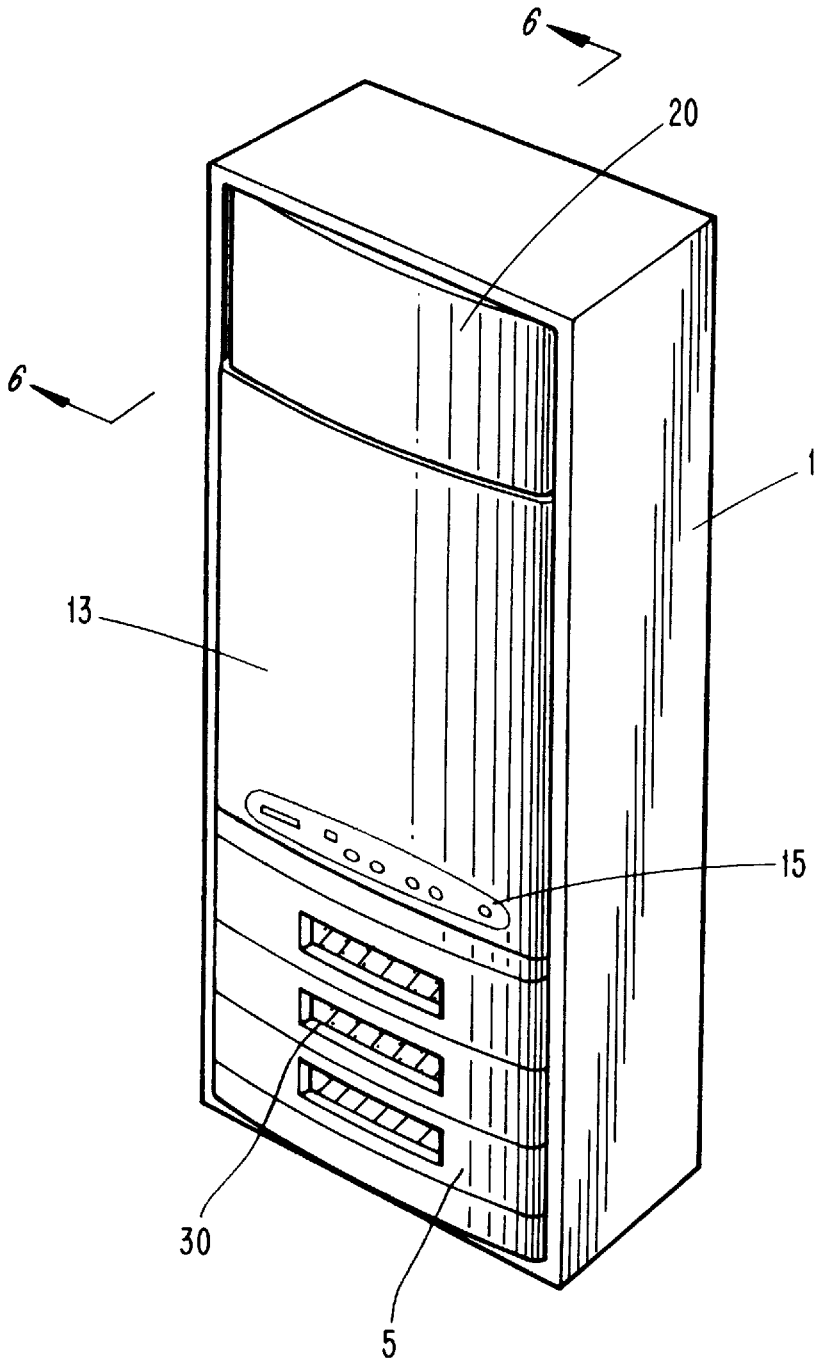
FIG. 3 is a schematic front perspective view illustrating the air conditioner according to the present invention, with the discharge outlet and the suction inlet closed.

As shown in FIG. 2 and FIG. 3, the main body 1 is provided on an upper portion thereof with a discharge outlet door 20 which serves to open the discharge outlet 7 for facilitating the supply of the air heat-exchanged by the heat exchanger 38 during the operation of the air conditioner, and to close the discharge outlet 7 for preventing dust or foreign substances from passing through the discharge outlet 7 and into the main body 1 during the stand-by state of the air conditioner. The discharging outlet door 20 is usually designed to give a good appearance, and adapted to be moved upward and downward for effecting the above operations.

Also, the main body 1 is provided on a lower portion thereof with a suction inlet door 30 which serves to open the suction inlet 3 for facilitating introduction of the indoor air through the suction inlet 3 during the operation of the air conditioner, and to close the suction inlet 3 for preventing dusts or foreign substances from passing through the suction inlet 3 and into the main body 1 during the stand-by of the air conditioner, wherein the suction inlet door 30 is usually designed to give a good appearance, and adapted to be moved upward and downward for effecting the above operations.

Figure 4:
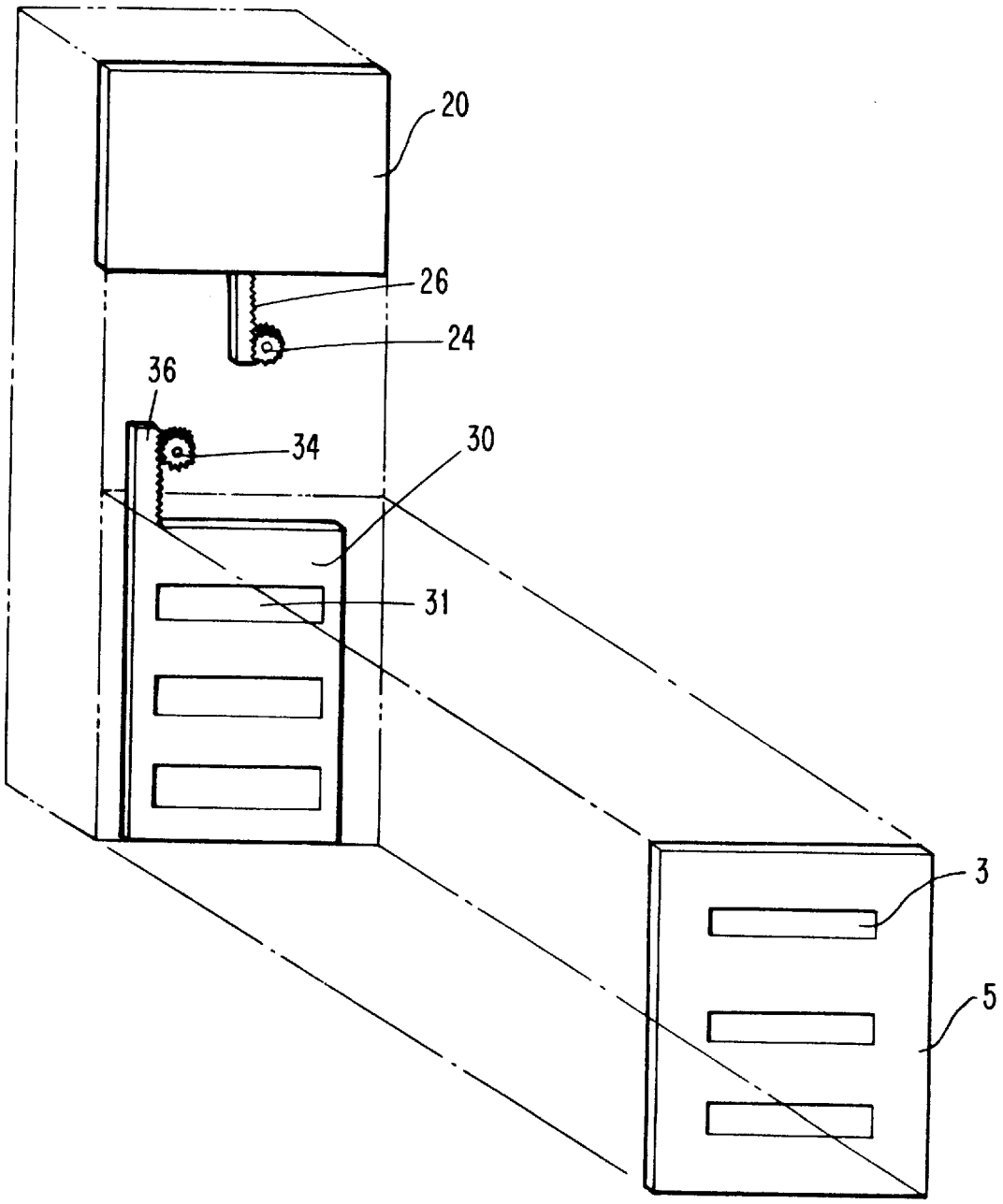
FIG. 4 is a schematic exploded front perspective view of the air conditioner in FIG. 3.
Figure 5:
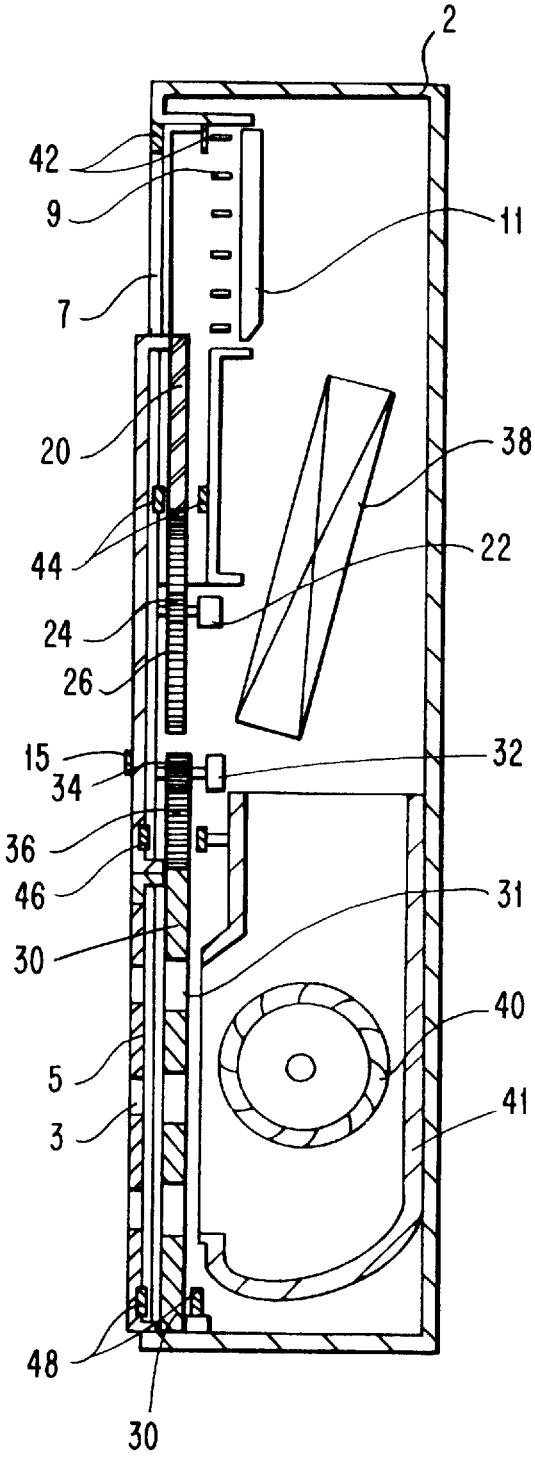
FIG. 5 is a sectional view taken along a line 5—5 shown in FIG. 2.
Figure 6:
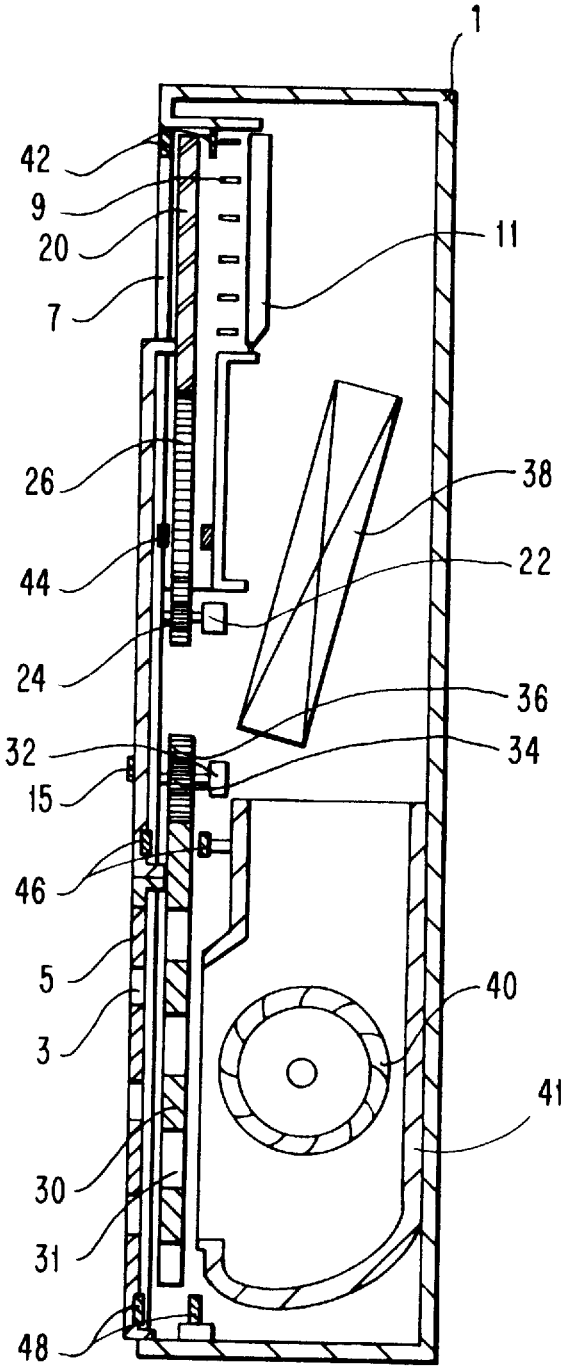
FIG. 6 is a sectional view taken along a line 6—6 shown in FIG. 3.

As shown in FIGS. 4 to 6, driving means for moving upward or downward the discharge outlet door 20 includes a first door motor 22 for generating a driving force for moving up or down the discharge outlet door 20, a first pinion 24 coupled to a shaft of the first door motor 22 such that the pinion 24 can be rotated by the driving force generated from the first door motor 22, and a first rack 26 for changing the rotary motion of a pinion 24 into the linear motion in cooperation with teeth of the pinion 24 such that the discharge outlet door 20 can be moved upward or downward when the first pinion 24 is rotated.

Also, the driving means for moving upward or downward the suction inlet door 30 includes a second door motor 32 for generating a driving force for moving up or down the suction inlet door 30, a second pinion 34 coupled to a shaft of the second door motor 32 such that the pinion 34 can be rotated by the driving force generated from the second door motor 32, and a second rack 36 for changing the rotary motion of a pinion 34 into the linear motion in cooperation with teeth of the pinion 34 such that the suction inlet door 30 can be moved upward or downward when the second pinion 34 is rotated.

The discharge outlet and suction inlet doors 20 and 30 are disposed inside the body 1 as is an oblong-shaped heat exchanger 38 to heat-exchange the room air sucked through the suction inlet 3, utilizing the evaporation latent heat of the refrigerant, with the desired cold or warm air. Below the heat exchanger 38 is disposed a blower fan 40 (hereinafter referred to as an indoor fan) for sucking the room air through the suction inlet 3 and also discharging indoors the heat-exchanged air through the discharging outlet 7. And, around the indoor fan 40 is installed a duct member 41 to guide the air flow from the suction inlet 3 to the discharge outlet 7.

Also, first to forth position detecting sensors 42, 44, 46 and 48 are installed in the passage through which the discharge outlet door 20 and suction inlet door 30 is moved through for detecting the opening or closing positions of said doors 20 and 30. Those sensors may comprise photo-sensor having a light emitting portion and a light receiving portion, respectively, and which becomes ON or OFF in response to the moving position of the discharge outlet door 20 and suction inlet door 30.

Figure 7:
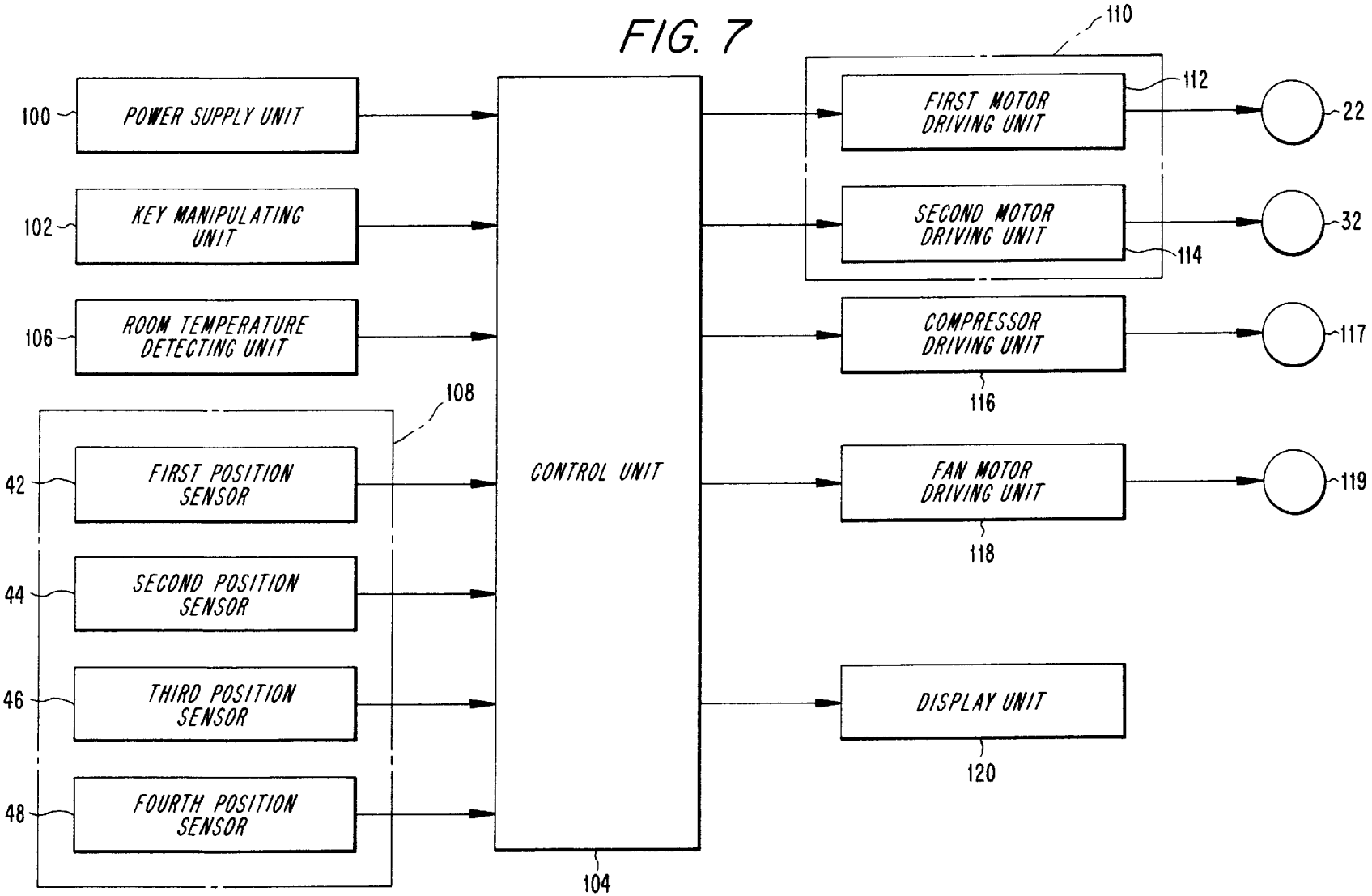
FIG. 7 is a control block diagram of the discharge outlet door opening or closing apparatus for the air conditioner according to the present invention.

Next, the control for closing or opening the discharge outlet 7 and suction inlet 3 of the air conditioner will be described with reference FIG. 7 illustrating a schematic control block diagram.

As shown in FIGS. 7 and 8, power supply means 100 serves to receive an electrical source voltage of commercial AC electrical power supplied from an AC power source stage, not illustrated, to convert the same to a predetermined DC voltage necessary for operation of the air conditioner and output the same. Key manipulating means 102 has a plurality of keys for selectively establishing the operational modes such as automatic mode, cooling, heating, defrost, air-cleaning, and so forth, of the air conditioner, an amount of such as strong, weak, soft and so forth air flow discharged through the discharge outlet 7 and the desired temperature Ts (hereinafter, referred to as a set temperature), as well as an operation key for a start/stop of the air conditioner.

Control means 104, which may comprise a microprocessor, receives direct voltage output from the power supply means 100 to initialize the air conditioner, and also controls general operations of the air conditioner in response to operation selection signals which are input through the key manipulating means 102. Also, the control means 204 controls supply of the power to the first and second door motors 22, 32 in response to the start/stop command from the key manipulating means 102.

Room temperature detecting means 106 is provided for detecting a temperature of the room air sucked through the suction inlet 3 such that the air conditioner operates in response to a comparison between the set temperature Ts and the detected temperature, an opening or closing detecting means 108 consisting of the first, second, third and forth position sensors 42, 44, 46, and 48 is provided for detecting whether the discharge outlet 7 and suction inlet 3 are opened or closed by the discharge outlet door 20 and suction inlet door 30.

And, opening or closing driving means 110 is provided for controlling the closing or opening of the discharge outlet door 20 and suction inlet door 30, when the start or stop command signals through the key manipulating means 102 is input, where the means 110 includes a first motor driving unit 112 for driving the first door motor 22 in order for the discharge outlet door 20 to be moved upward or downward in response to the control signal from the control means 104, and a second motor driving unit 114 for driving the second door motor 32 in order for the suction inlet door 30 to be moved upward or downward in response to the control signal from the control means 104.

Compressor driving means 116 drives the compressor 117 in response to the control signal from the control means 104 when a difference between the set temperature Ts and the room temperature Tr detected by the room temperature detecting means 106 exists, and fan motor driving means 118 drives the indoor fan 40 by controlling the speed of the indoor fan motor 119 in response to the control signal from the control means 104, for blowing indoors the air heat-exchanged by the heat exchanger 38.

Display means 120 displays, under the control of the control means 104, the operation selected mode (automatic mode, cooling, heating, defrost, air-cleaning, and so forth, of the air conditioner) applied from the key manipulating means 102, and the room temperature, as well as the operation conditions of the air conditioner.

The operation and advantages of such a structured discharge outlet closing/opening apparatus for the air conditioner and method therefor will be described.

Figure 8A:
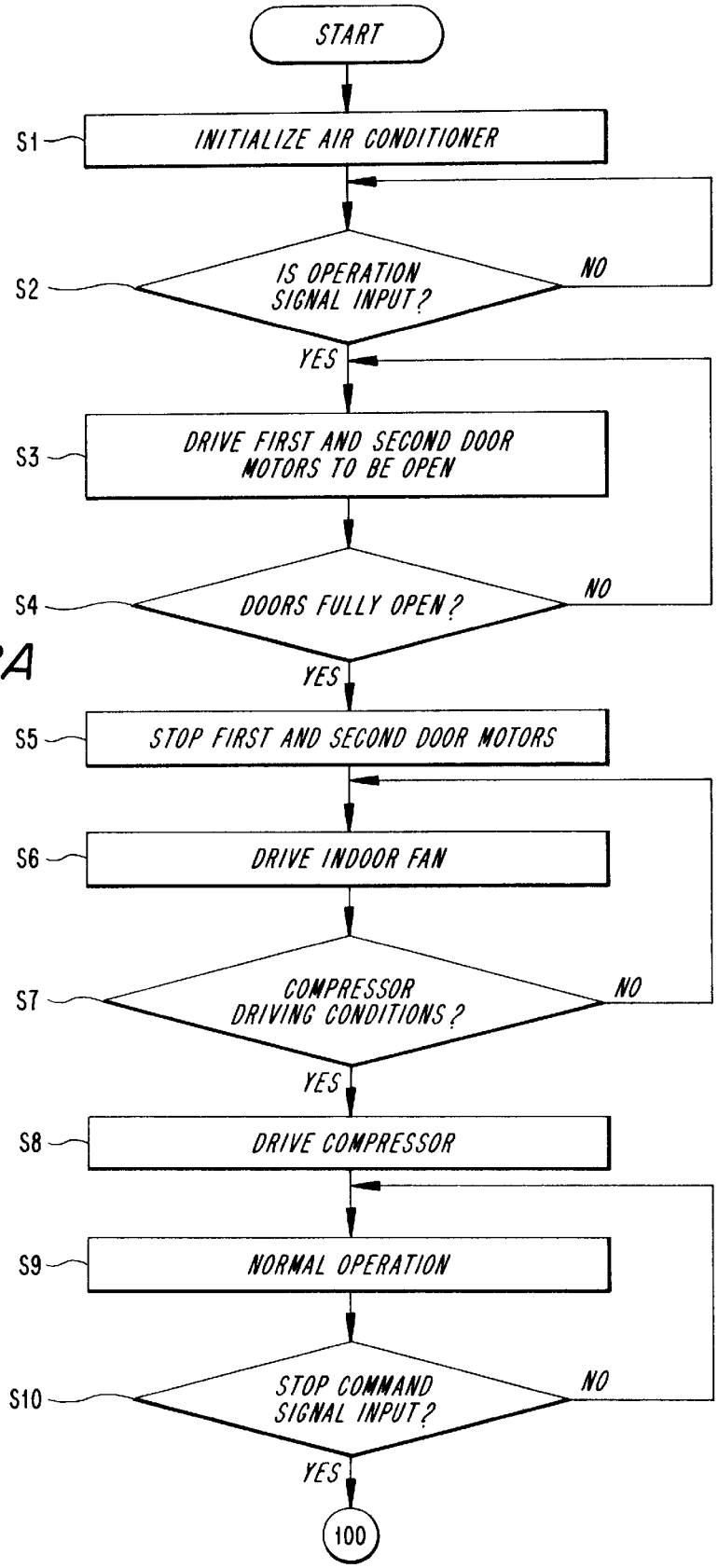
FIGS. 8A and 8B are flow charts illustrating sequential control procedures for opening or closing the discharge outlet door of the air conditioner.
Figure 8B:
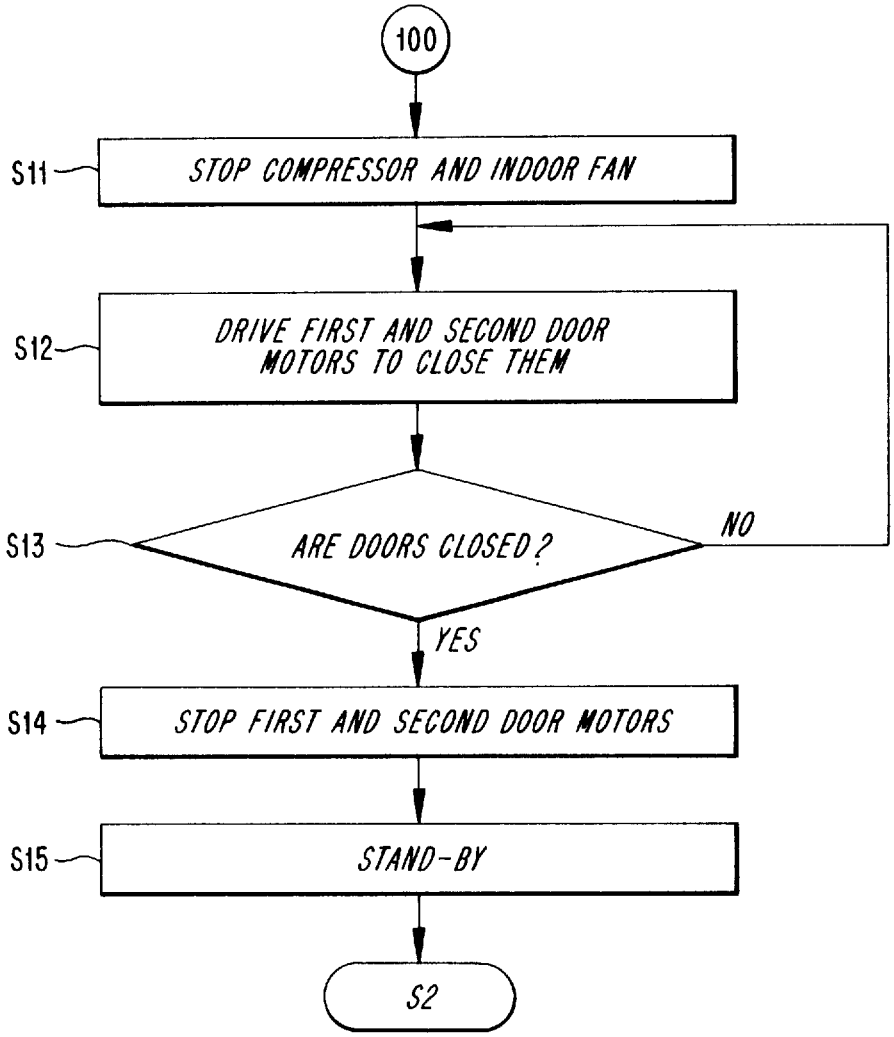

FIGS. 8A and 8B are flow charts illustrating sequential control procedures for opening or closing the discharge outlet of the air conditioner.

It is assumed that the discharge outlet 7 and the suction inlet 3 are closed as an initial condition for the purpose of the explanation.

First, when a power is applied to the air conditioner, the power supply means 100 performs such that a commercial AC power supplied from an AC power stage (not shown) is converted into a DC voltage with a voltage level required to activate the air-conditioner, in which the converted DC voltage is applied to the control means 104 and each of the driving circuits.

When a DC voltage from power supply means 100 is applied to control means 104, the air conditioner is initialized by the control means 104 (step S1).

If the user sets the desired operational mode, for example, cooling and desired temperature Ts, and then depresses an operation key, an operation selection signal and operation start signal (hereinafter, referred to as an operation signal) from the key manipulating means 102 are applied to the control means 104.

Thus, at step S2, the control means 104 determines whether the operation signal is applied or not, if not (in case of NO), it maintains a stand-by state of the air conditioner and repeats step S2.

If the operation signal is input (in case of Yes), the process advances to step S3 in which the control means 104 outputs a control signal, for opening the suction inlet 3 and the discharge outlet 7 to the opening or closing driving means 110.

Then, the first motor driving unit 112 subjected to the control of the control means 104 drives the first door motor 22 in a forward direction which causes the first pinion 24 coupled to the shaft of the first door motor 22 to be rotated, thus moving downward the first rack 26 by the rotation of the pinion, so that the discharge outlet door 20 coupled the rack 26 is moved in the same direction to open the discharge outlet 7. Similarly, the second motor driving unit 114 subjected to the control of the control means 104 drives the second door motor 32 in a forward direction which causes the second pinion 34 coupled to the shaft of the second door motor 32 to be rotated, thus moving downward the second rack 36 by the rotation of the pinion 34, so that the suction inlet door 3 coupled the second rack 36 is moved in the same direction to open the suction inlet 7.

The forward rotation of both the first and second door motors 22 and 32 lowers both the discharge outlet door 20 and suction inlet door 30, in which the light emitted from the light emitting portions of the first and third position sensors 42, 46 are transmitted to the light receiving portion. This serves to input high level signals from the first and third position sensors 42, 46 to the control means 104.

Accordingly, at step S4, the control means 104 receives high level signals issued from the first and third position sensors 42, 46 to determine if the discharge outlet door 20 and the suction inlet door 30 are opened or not. If not (in case of NO), the process returns to step S3 where the first and second door motors 22, 32 continue to be driven until the discharge outlet door 20 and the suction inlet door 30 are fully opened.

In case of YES from step S4, which means that the discharge outlet door 20 and the suction outlet door 30 are opened, the process advances to step S5 where the control means 104 controls the first and second motor driving unit 112, 114 for stopping the first and second door motors 22, 32, thereby to complete the opening of the suction outlet door 30.

If the discharge outlet door 20 and the suction outlet door 30 are opened, at step S6, the control of the the indoor fan motor 119 is made by the control means 104 for driving the indoor fan 40.

Upon the driving of the indoor fan 40, the suction of the indoor air into the main body 1 is made through the suction inlet 3 and a suction opening 31 in the suction inlet door 30, wherein the temperature Tr of the indoor air sucked through the suction inlet 3 and the opening 31 is detected by the room temperature detecting means 106. Then, at step S7, a comparison is made between the indoor temperature Tr detected by the room temperature detecting means 106 and the temperature Ts set by the user through the key manipulating means 102, followed by a decision to see if one of the conditions for driving the compressor 117 is met, corresponding to one of two modes, a first mode corresponding to cooling in which the compressor 117 is to be operated when the room temperature Tr detected by the room temperature detecting means 106 is higher than the set temperature Ts, and a second mode corresponding to heating in which the compressor 117 is to be operated when the room temperature Tr detected by the room temperature detecting means 106 is lower than the set temperature Ts.

If the comparison result at step S7 does not correspond to the condition for driving the compressor 117 (in case of No), the process returns to step S6 to continue to detect the room temperature Tr and repeat the steps. If the comparison result at step S7 corresponds to the condition for driving the compressor 61 (in case of YES), the flow advances to step S8 where an operation frequency for the compressor 61 is determined depending upon a difference between the temperatures Tr and Ts, and the control signal for driving the compressor 61 is provided to the compressor driving means 60.

The compressor driving means 116 is driven based upon the operation frequency defined by the control means 104.

The drive of the compressor 117 is accompanied with the drive of the indoor fan 30 (step S9), which allows the room air to be taken in the main body 1 through the suction inlet 3. Then, the sucked room air passes the heat-exchanger 38 through which the air is heat-exchanged with the cold or warm air by the evaporating latent heat of the refrigerant flowing in the heat-exchanger.

The air heat-exchanged through the heat-exchanger 38 is guided into an upper portion of the body 1 and then discharged indoors through the discharge outlet 7 with an adjustment of an air flow direction according to a controlled displacement of air flow blades 9, 11 pivotally provided in the discharge outlet 7, for accomplishing the conditioning of the indoor air.

Then, at step S10, under the normal operation of the air-conditioning, it is determined whether or not the operation stop command signal is issued by an OFF state of the operation key in the key manipulating means 102, if not (in case of NO), the process returns to step S9 and the normal operation continues. As a result of the determination at step S10, if the operation stop command signal is issued (in case of YES) during the normal operation, the process advances to step S11, in which the control means 104 outputs the control signal to the compressor driving means 116 and the fan motor driving means 118 to disable the compressor 117 and the indoor fan motor 119, respectively. Under the control of the control means 116, the compressor driving means 116 serves to stop the compressor 117, and the fan motor driving means 118 serves to stop the indoor fan motor 119, which causes the indoor fan 40 to stop its operation.

Next, the process advances to step S12 in which the control signal for closing the suction inlet 3 and the discharge outlet 7 is output from the control means 104 to the first and second motor driving units 112, 114.

Accordingly, the first motor driving unit 112 subjected to the control of the control means 104 drives the first door motor 22 in a reverse direction which causes the first pinion 24 coupled to the shaft of the first door motor 22 to be rotated, thus moving upward the first rack 26 by the rotation of the pinion, so that the discharge outlet door 20 coupled the rack 26 is moved in the same direction to close the discharge outlet 7. Similarly, the second motor driving unit 114 subjected to the control of the control means 104 drives the second door motor 32 in a reverse direction which causes the second pinion 34 coupled to the shaft of the second door motor 32 to be rotated, thus moving upward the second rack 36 by the rotation of the pinion 34, so that the suction inlet door 3 coupled the second rack 36 is moved in the same direction to close the suction inlet 7.

The reverse rotation of both the first and second door motors 22 and 32 raises both the discharge outlet door 20 and suction inlet door 30, in which the light emitted from the light emitting portions of the first and third position sensors 42, 46 are not transmitted to the light receiving portion, while the light emitted from the light emitting portions of the second and forth position sensors 42, 46 are transmitted to the light receiving portion. This allows low level signals from the first and third position sensors 42, 46 and high level signals from the second and fourth position sensors 44, 48 to be input to the control means 104, respectively.

Accordingly, at step S13, the control means 104 receives high level signals issued from the first and third position sensors 42, 46 to determine if the discharge outlet door 20 and the suction inlet door 30 is closed or not, if not (in case of NO), the process returns to step S3 where the first and second door motors 22, 32 continue to be driven until the discharge outlet door 20 and the suction inlet door 30 are fully closed.

In case of YES from the decision step S13, this meaning that the discharge outlet door 20 and the suction outlet door 30 are closed, the process advances to step S14 where the control means 104 controls the first and second motor driving unit 112, 114 for stopping the first and second door motors 22, 32, thereby to complete the closing of the suction outlet door 30.

If the discharge outlet door 20 and the suction outlet door 30 are closed, then at step S15, the control means 104 controls to maintain the stand-by state of the air conditioner until the operation signal is present again, and the process returns to step S2 for repeatedly performing the subsequent steps.

According to the discharge outlet opening or closing apparatus for the air conditioner and the associated method therewith in accordance with the present invention, at the stand-by state of the air conditioner, the introduction of dust or foreign substances into the product can be prevented by closing both the suction inlet 3 and the discharge outlet 7, the performance of the product can be improved and a good external appearance of the product can be promoted.

What is claimed is:

1. In an air conditioner comprising a vertically extending inlet for sucking in room air, an indoor heat exchanger for heat-exchanging the sucked-in air, a vertically extending outlet for discharging the heat-exchanged air, the outlet spaced vertically from the inlet, and an apparatus for opening/closing the inlet and outlet, comprising:

an outlet door slidable vertically for opening or closing the outlet so as to prevent dust and foreign substances from entering the air conditioner through the outlet;

an inlet door slidable vertically for opening or closing the inlet to prevent dust and foreign substances from entering the air conditioner through the suction inlet;

driving mechanisms for opening or closing the outlet door and the inlet door by sliding the outlet and inlet doors vertically;

detectors for detecting respective vertical positions of the outlet door and the inlet door; and a controller connected to the detectors and the driving mechanisms for controlling the driving mechanisms such that the outlet door and the inlet door are opened or closed based upon signals from the detectors.

2. The apparatus as claimed in claim 1, wherein the driving mechanisms comprise a first door motor for opening or closing the outlet door, and a second door motor for opening or closing the inlet door.

3. The apparatus as claimed in claim 1, wherein the controller controls an application of a power to the driving mechanisms for simultaneously opening or closing the outlet door and the inlet door.

4. The apparatus according to claim 1 wherein the inlet is disposed below the outlet, the detectors arranged for detecting edges of the respective outlet and inlet doors after such edges have vertically traversed the respective outlet and inlet.

5. A method for closing or opening a vertically extending outlet door and an inlet door of a vertically extending air conditioner, the inlet and outlet doors spaced vertically apart, the method comprising the steps of:

A) determining whether or not a start or stop command signal is input to a key manipulating means;

B) controlling driving mechanisms for opening or closing the outlet door and the inlet door by sliding those doors vertically simultaneously in response to input start and stop command signals, respectively;

C) determining whether the outlet door and the inlet door have reached a selected open or closed state by detecting respective vertical positions of the outlet door and the inlet door; and D) terminating the door driving mechanisms in response to both doors having reached the selected open or closed state.

6. The method according to claim 5 wherein step B comprises operating a first motor operably connected to the inlet door, and simultaneously operating a second motor operably connected to the outlet door.

7. The method according to claim 5 wherein step C comprises detecting edges of the respective inlet and outlet doors, after such edges have vertically traversed the respective inlet and outlet.

* * * * *